US006799861B2

(12) United States Patent
Naghi et al.

(10) Patent No.: US 6,799,861 B2
(45) Date of Patent: Oct. 5, 2004

(54) PORTABLE LIGHTING APPARATUS AND METHOD OF USE

(75) Inventors: David Naghi, Los Angeles, CA (US); Eric A. Hanscom, Los Angeles, CA (US)

(73) Assignee: Technology Creations, Inc., Los Angeles, CA (US)

( * ) Notice: Subject to any disclaimer, the term of this patent is extended or adjusted under 35 U.S.C. 154(b) by 55 days.

(21) Appl. No.: 09/810,795

(22) Filed: Mar. 15, 2001

(65) Prior Publication Data

US 2002/0131263 A1 Sep. 19, 2002

(51) Int. Cl.[7] ..... F21V 33/00

(52) U.S. Cl. ..... 362/198; 362/253; 361/683; 361/686

(58) Field of Search ..... 362/85, 109, 198, 362/199, 190, 191, 253, 396, 197, 419; 345/82; 361/683, 686; 348/373; G06G 3/32; F21V 33/00

(56) References Cited

U.S. PATENT DOCUMENTS

| | | | | |
|---|---|---|---|---|
| 1,651,307 A | | 11/1927 | Wilkinson | |
| 3,065,339 A | | 11/1962 | Fahey, Jr. et al. | 240/25 |
| D238,959 S | | 2/1976 | Kurokawa et al. | D48/20 F |
| D251,687 S | | 4/1979 | Kurokawa | D48/20 F |
| 5,122,937 A | | 6/1992 | Stoudemire | 362/109 |
| 5,122,941 A | | 6/1992 | Gross et al. | 362/276 |
| 5,136,477 A | | 8/1992 | Lemmey | 362/198 |
| 5,183,325 A | | 2/1993 | Hurdle | 362/109 |
| 5,369,560 A | * | 11/1994 | Friedman | 362/396 |
| 5,379,201 A | | 1/1995 | Friedman | 362/191 |
| D377,840 S | | 2/1997 | Chang | D26/62 |
| 5,612,733 A | * | 3/1997 | Flohr | 348/14.16 |
| 5,615,945 A | | 4/1997 | Tseng | 362/226 |
| 5,702,175 A | * | 12/1997 | Chen | 362/191 |
| D418,240 S | | 12/1999 | Sherman | D26/63 |
| 6,141,052 A | * | 10/2000 | Fukumitsu et al. | 348/373 |
| 6,406,161 B1 | * | 6/2002 | Lin et al. | 362/287 |
| 6,587,151 B1 | * | 7/2003 | Cipolla et al. | 348/373 |
| 2001/0048409 A1 | | 12/2001 | Kim | 345/82 |

FOREIGN PATENT DOCUMENTS

| | | | |
|---|---|---|---|
| DE | 9417969.7 | | 2/1995 |
| JP | 410224687 A | * | 8/1998 |
| JP | 2000200115 A | * | 7/2000 |

OTHER PUBLICATIONS

Amazon.com product web page printout for "Adventure Book Light and Flashlight" by Lumatec; http://www.amazon.com/exec/obidos/ASIN/b00000IJZM/104–9549104–0986847; printed Mar. 2, 2000.

Book light product internet web page printout; http://store1.yimg.com/I/parksherman_1550_902141; printed Mar. 2, 2000.

"Designed Halogen Lamps With Multiple Features,"*Taiwan Lighting*, Feb. 1997, p. 69.

FlyLight™ Notebook USB Light, Kensington Products; http://www.kensighton.com/products/pro_d1334.html, Printed Feb. 15, 2001.

(List continued on next page.)

*Primary Examiner*—Thomas M. Sember
(74) *Attorney, Agent, or Firm*—Stephen C. Beuerle; Procopio Cory Hargreaves & Savitch LLP

(57) ABSTRACT

A light including a bendable body including opposite terminating portions, respective light sources carried at the terminating portions, at least one power source to power the light sources, wherein the bendable body is adapted to be wrapped at least partially around at least one of a user's neck and head to secure the light and adjusted so that the light sources are oriented in a desired configuration for optimal lighting of the one or more objects.

9 Claims, 4 Drawing Sheets

OTHER PUBLICATIONS

Igo.com product web page printout for "NBL–100 Notebook Light" by Interex; http://www.igo.com/cgi–bin/ncommerce3/ProductDisplay?prmenbr=1&prrfnbr–522530; printed Jul. 21, 2000.

Sierra Gold Marketing "SGM28367" Clip On Light product web page printout; http://www.sgm.simplenet.com/boutique/special/sgm28367.html; printed Mar. 2, 2000.

"The Ittybitty Book Light" internet web page printout; http://www.zelco.com/10013.jpg; printed Mar. 2, 2000.

"Ultimate Palmtop Computer Lights™" internet web page printout; http://www.std.com/sfl/3.pct.html; printed Mar. 2, 2000.

* cited by examiner

PORTABLE LIGHTING APPARATUS AND METHOD OF USE

FIELD OF THE INVENTION

The present invention is in the field of portable lighting devices for illuminating objects.

BACKGROUND OF THE INVENTION

Reading lights such as book lights have been proposed in the past for illuminating the pages of a book in inadequate lighting conditions. A problem with these lights is that they tend to be relatively heavy and bulky, making their use impractical and clumsy, especially when used with pliable publications and/or small publications such as magazines and soft cover books. If used on a magazine, the bulkiness and weight of these reading lights bends the pages of the magazine, making their use impractical and clumsy. Another problem with these reading lights is that they use incandescent or fluorescent bulbs. Such light bulbs consume a relatively large amount of electricity, are inefficient, generate heat, and give only partial lighting across the entire visible spectrum. As a result, these reading lights require relatively large, more powerful batteries, consume batteries quickly, may bum the reader if the incandescent bulb comes in contact with the reader, require relatively large light housings to accommodate the heat of the incandescent bulb and large batteries, and provide unsatisfactory lighting of the reading materials. Also, the heaviness of prior book lights and the heat of the bulb create an inherently dangerous potential for fire if the light bends the flammable magazine or book page over and the hot bulb contacts the page.

Accordingly, there is a long felt need for a simple, light-weight, energy-efficient, economical device that can adequately illuminate pliable reading materials and/or small reading materials such as magazines and soft cover books without the drawbacks associated with prior reading lights.

There is also a long felt need for a simple, light-weight, energy-efficient, economical device and related method that can be used with other objects such as, but not by limitation, laptop computers, Personal Digital Assistants, digital cameras, and for general lighting of objects.

SUMMARY OF THE INVENTION

An aspect of the invention involves a method of illuminating one or more objects associated with a laptop computer comprising the steps of attaching a light to a support surface of the laptop computer and illuminating one or more objects associated with the laptop computer with at least one LED of the light.

An additional aspect of the invention involves a method of illuminating one or more objects associated with a PDA comprising the steps of attaching a light to a support surface of the PDA and illuminating one or more objects associated with the PDA with at least one LED of the light.

A further aspect of the invention involves a light for lighting one or more objects. The light includes a bendable body including opposite terminating portions, respective light sources carried at the terminating portions, at least one power source to power the light sources, wherein the bendable body is adapted to be wrapped at least partially around at least one of a user's neck and head to secure the light and adjusted so that the light sources are oriented in a desired configuration for optimal lighting of the one or more objects.

A still further aspect of the invention involves a method of illuminating one or more objects comprising the steps of providing a light including a bendable body with opposite terminating portions, respective light sources carried at the terminating portions; wrapping the bendable body at least partially around a user's neck; adjusting the bendable body so that the light sources are oriented in a desired configuration; and illuminating one or more objects with the illumination sources.

A yet further aspect of the invention includes a method of illuminating an object of a camera. The method includes providing an attachable light including at least one LED powered by at least one power source; attaching the light to a support surface; and illuminating an object of a camera with the light.

Further objects and advantages will be apparent to those skilled in the art after a review of the drawings and the detailed description of the preferred embodiments set forth below.

DETAILED DESCRIPTION OF PREFERRED EMBODIMENTS

Figure 1:
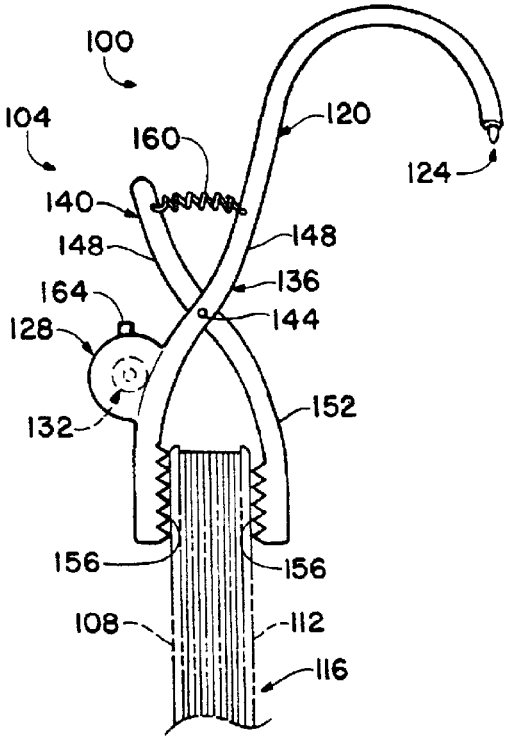
FIG. 1 is a side-elevational view of an embodiment of a reading light attached to a reading publication.

With reference to FIG. 1, a reading light 100 constructed in accordance with an embodiment of the invention will now be described. The reading light 100 includes a mounting mechanism 104 for mounting the reading light to a reading support surface such as, but not limited to, a cover 108, one or more pages 112, and/or a spine of a reading publication 116 and an adjustable, bendable body portion 120 that terminates at one end in at least one light source 124 for illuminating the page(s) 112 of the publication 1 16. The bendable body portion 120 may have a configuration other than that shown such as, but not by way of limitation, coiled, curvilinear, serpentine, wave-like, or rectilinear. If the bendable body portion 120 is coiled and becomes uncoiled, the bendable body portion 120 can be reshaped into a coil by bending and wrapping the body portion 120 around a pen, pencil, or similar instrument and removed. The mounting mechanism 104 carries a power housing 128 that houses at least one power source 132 for powering the light source 124.

The mounting mechanism 104 includes first and second arms 136, 140, respectively, pivotally connected by a pin 144. The arms 136, 140 include upper arm portions 148 and lower arm portions 152. The upper arm portion 148 of the first arm 136 merges into the adjustable, bendable body portion 120. Both the first arm 136 and body portion 120 carry a bendable wire that electrically couples the power source 132 with the LED 124. The lower arm portion 152 of the first arm carries the power housing 128. The lower arm portions 152 terminate in opposing engagement teeth 156. A spring 160 extends between the upper arm portions 148.

The light source 124 is preferably a wide-angle, white LED 9 that may be housed in a light housing (not shown). Although the light source 124 is shown as a single LED, multiple LEDs may be used. An LED is advantageous because it draws little electrical power during operation, prolonging the power life of the power source 132. The low-power draw of the LED is especially advantageous with respect to a reading light because a low power draw allows for a small power source, and, hence, a small reading light. A smaller reading light means the reading light can be attached to pliable pages and/or a cover without bending the pages/cover. A smaller reading light is also less clumsy than a larger reading light. An LED is small, lightweight and also does not burn out like conventional filament light bulbs, as used in prior art reading lights. As a result, the LED does not need to be replaced, reducing maintenance of the light 100. Because an LED does not emit heat, it uses power more efficiently and can be formed into plastic without heat-warping effects on the light housing. An LED also does not have a filament like conventional bulbs used in prior art reading lights. Therefore, an LED casts light in a more even and focused manner than bulbs used in prior reading lights. The wide-angle LED broadly casts light across the entire page 112 or adjacent pages 112 of the reading publication 116, while at the same time allowing the reading light 100 to rise a short distance above the page 112, resulting in a low-profile reading light 100. The low profile of the reading light 100 reduces the obstructive effect the light 100 may present to a user reading the publication 116 and reduces torque bending on pliable pages 112 or a cover 108. A white light LED is further preferred because it emits the full spectrum of visible light, unlike conventional light bulbs used in prior art reading lights, resulting in more vibrant, vivid and true colors. The resulting light from a white light LED is also more comfortable to a reader's eyes than the light from conventional light bulbs.

Because the LED draws little power, the power source 132 is a small, low-voltage power source such as, but not limited to, an AA battery, an AAA battery, an AAA battery, or a watch battery. Disposable or non-disposable (e.g., rechargeable) batteries may be used. Other power sources such as, but not by way of limitation, one or more fuel cells may also be used. Although a single power source 132 is shown, multiple power sources 132, e.g., batteries, may be used to power the LED. A switch 164 such as an on/off switch is preferably used to turn the reading light 100 on or off. A dimmer switch, e.g., a variable resistor, may be used for controlling the brightness of the light source 124.

The reading light 100 will now be described in use. The reading light 100 is mounted or applied to the reading publication 1 16 by clamping the engagement teeth 156 of the lower arm portions 152 onto a support surface of the reading publication 116. Possible support surfaces may include one or more of the following: a hard cover, a soft cover, one or more pages or surfaces of the book, magazine, article, document, brochure, binder, folder, planner, personal organizer, map, any paper items used on a clipboard, a clipboard, and the like. The mounting mechanism 104 is applied to the support surface by squeezing the upper arm portions 148 with enough force to overcome a counteracting force by the spring 160, locating the engagement teeth 156 of the lower arm portions 152 over the support surface, and releasing the pressure on the upper arm portions 148 so that the spring 160 causes the lower arm portions 152 and teeth 156 to grip the support surface. The light source 124 is activated by moving the switch 164 to an "on" position and deactivated by moving the switch 164 to an "off" position. The light source 124 is oriented to a desired position by bending the adjustable, bendable body 120 to a desired configuration. The low profile of the reading light 100 caused by using a wide-angle LED, and light weight of the tool light 100 caused by using a small power source and an LED reduces the torque forces on the pliable page(s) and/or soft cover of the book, magazine, etc., preventing bending of the pliable pages of the reading publication 116 when the reading light 100 is mounted to the publication 116. The design also allows the reading light 100 to be mounted in the middle of the book, magazine, or spine for better support without obstructing text, pictures, or printed areas. The reading light 100 may also be mounted to the side of a reading support surface.

Figure 2:
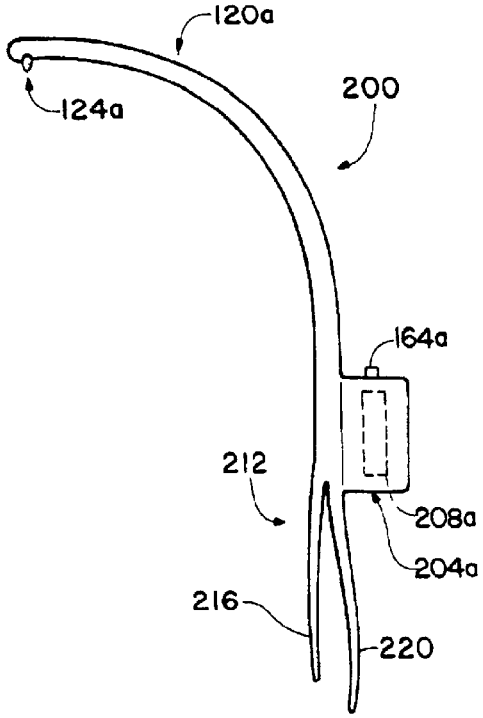
FIG. 2 is a side-elevational view of an additional embodiment of a reading light.

With reference to FIG. 2, a reading light 200 constructed in accordance with an additional embodiment of the invention will now be described. Elements similar to those described above with respect to FIG. 1 are identified with like reference numerals, but with an "a" suffix. The reading light 200 is similar to the reading light 100 described above with respect to FIG. 1, except a power housing 204 is sized to carry a small, flat watch battery 208 and a mounting mechanism 212 is different than the mounting mechanism 104 discussed with respect to FIG. 1. The mounting mechanism 212 is a sleeve defined by a first generally rectangular, flexible sleeve member 216 and a second generally rectangular, flexible sleeve member 220.

Figure 3:
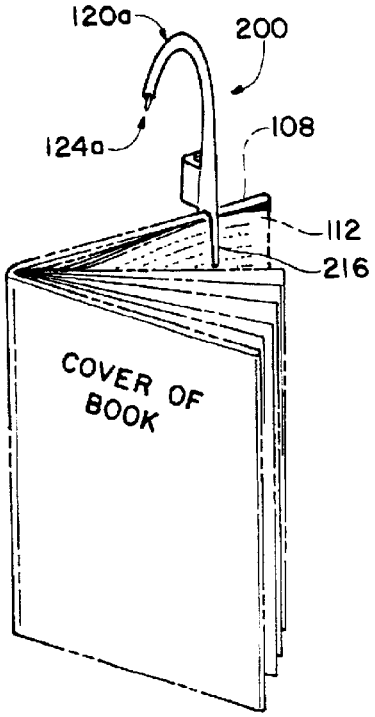
FIG. 3 is perspective view of the reading light illustrated in FIG. 2 attached to a back cover and multiple pages of a soft-cover book.

With reference additionally to FIG. 3, use of the reading light 200 is similar to that described above for the reading light 100, except instead of clipping the reading light 100 to the publication 116, the sleeve 212 of the reading light 200 is slid over the cover 108 and/or the one or more pages 112 to attach the reading light 100 to the reading publication 116. When the reading light 100 is mounted to the reading publication 116, the reading support surface is disposed between the first generally rectangular, flexible sleeve member 216 and the second generally rectangular, flexible sleeve member 220. The light source 124*a*, e.g., LED, is activated by moving the switch 164*a* to the "on" position and deactivated by moving the switch 164*a* to the "off" position.

Figure 4:
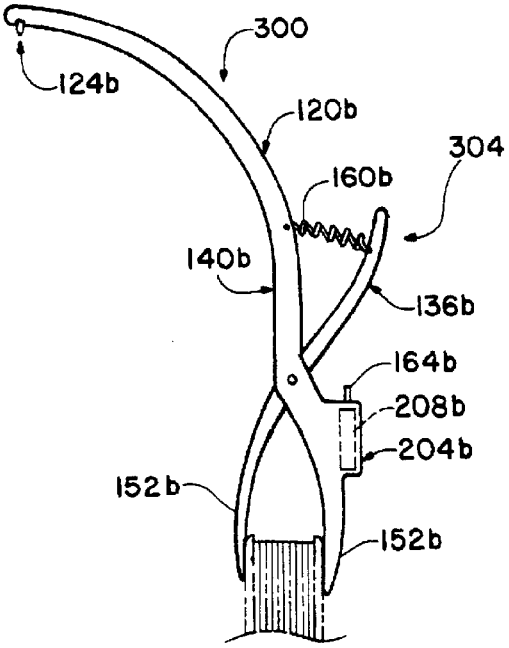
FIG. 4 is a side-elevational view of another embodiment of a reading light.

With reference to FIG. 4, a reading light 300 constructed in accordance with another embodiment of the invention will now be described. Elements similar to those described above with respect to FIGS. 1–3 are identified with like reference numerals, but with a "b" suffix. The reading light 300 is similar to the reading light 200 described above with respect to FIGS. 2 and 3, except a mounting mechanism 304 is different than the mounting mechanism 212. The mounting mechanism 304 is a clip-like mechanism similar to the mounting mechanism 104 described above with respect to FIG. 1, except the lower arm portions 152*b* do not include opposing sets of engagement teeth 156. The reading light 300 is applied to the cover 108 and/or one or more pages 112 of the publication 116 in the same manner as that described above for the reading light 100.

Figure 5:
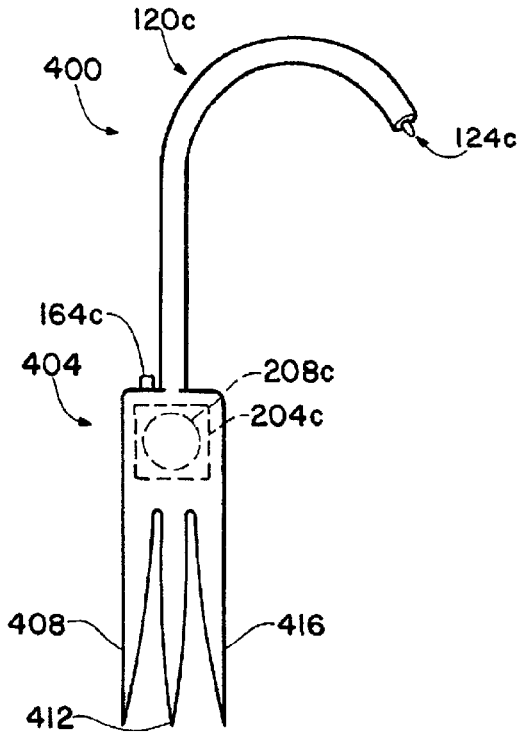
FIG. 5 is a side-elevational view of a further embodiment of a reading light.
Figure 6:
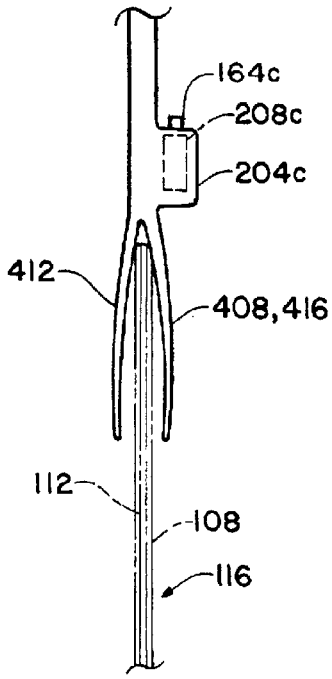
FIG. 6 is an end view of the reading light illustrated in FIG. 5 attached to a page of a reading publication.

With reference to FIGS. 5 and 6, a reading light 400 constructed in accordance with a further embodiment of the invention will now be described. Elements similar to those described above with respect to FIGS. 1–4 are identified with like reference numerals, but with a "c" suffix. The reading light 400 is similar to the reading light 200 described above with respect to FIGS. 2 and 3, except a mounting mechanism 404 is different than the mounting mechanism 212. The mounting,mechanism 404 includes three elongated, flexible, triangular fingers: a first finger 408, a second finger 412, and a third finger 416. With reference to FIG. 6, the reading light 400 is mounted to the reading publication 116 by sliding the mounting mechanism 404 over the cover 108 and/or the one or more pages 112 so that the first finger 408 and third finger 416 are disposed on one side and the second finger 412 is disposed on the other side.

Figure 7:
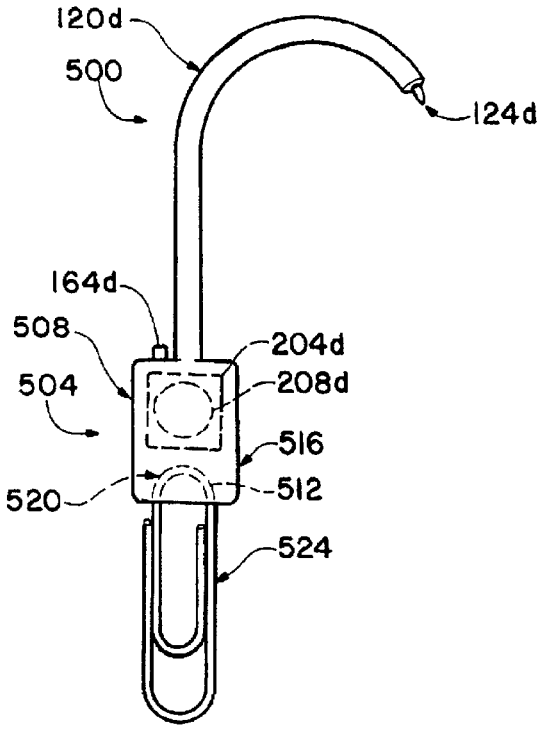
FIG. 7 is a side-elevational view of a further embodiment of a reading light.

With reference to FIG. 7, a reading light 500 constructed in accordance with a still further embodiment of the invention will now be described. Elements similar to those described above with respect to FIGS. 1–5 are identified with like reference numerals, but with a "d" suffix. The reading light 500 is similar to the reading lights described above, but has a different mounting mechanism 504. The mounting mechanism 504 includes a base 508 with a recess 512 in a bottom portion 516. The recess is configured to slidably receive a top portion 520 of a paper clip 524. The reading light 500 is mounted to the reading publication 116 by sliding the paper clip 524 over the cover 108 and/or the one or more pages 112.

Figure 8:
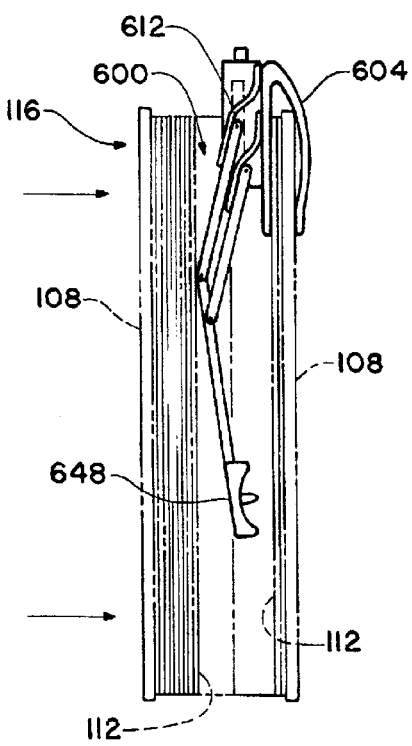
FIG. 8 is a side-elevational view of a still further embodiment of a reading light, with the reading light shown in a closed, collapsed position.
Figure 9:
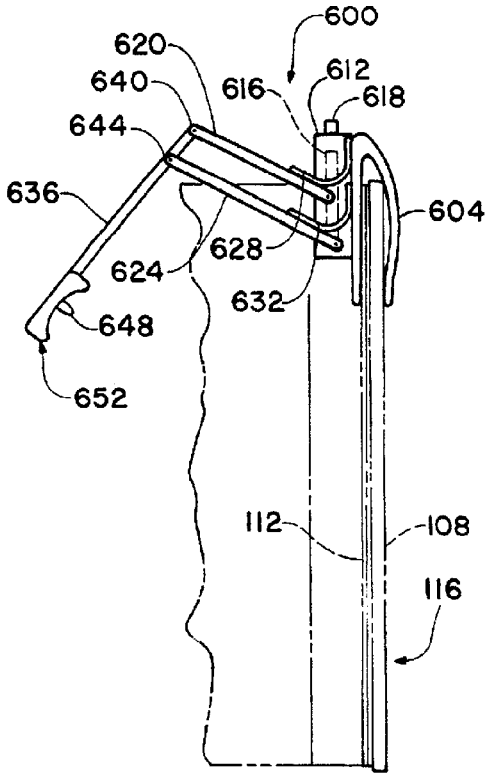
FIG. 9 is a side-elevational view of the reading light of FIG. 8, with the reading light shown in an active, expanded position.

With reference to FIGS. 8 and 9, a reading light 600 constructed in accordance with a still further embodiment of the invention will now be described. The reading light 600 includes a flexible U-shaped bracket 604 that is configured to mount to the cover 108 and/for one or more pages 112 of the publication 116. A base 612 is attached to the bracket 604 and carries a power source 616 such as a watch battery. The base 612 may also carry an on/off switch 618 for activating or deactivating the reading light 600. A pair of pivot arms 620, 624 are pivotally connected to the base 612. A pair of respective springs 628, 632 extend between the base 612 and the pivot arms 620, 624. A support arm 636 is pivotally connected to distal ends 640, 644 of the pivot arms 620, 624. The support arm 636 carries a light source 648, e.g., LED. The light source 648 is located within a light housing 652. The light source 648 is electrically coupled to the power source 616.

In use, the reading light 600 is attached to the reading publication 116 by mounting the bracket 604 to the cover 108 and/or the one or more pages 112. The springs 628, 632 urge the pivoting arms 620, 624 to the active, expanded position shown in FIG. 9. In this position, the support arm 636 is automatically oriented in the position shown for illuminating the page(s) 112 with the light source 648. The light source 648 may be activated by moving the switch 618 to the "on" position. In an alternative embodiment, instead of (or in addition to) the switch 618, the position of at least one of the pivoting arms 620, 624, may control the on/off condition of the light source 648. For example, the light source 648 may be automatically activated when the reading light 600 is in the position shown in FIG. 9 and deactivated when the reading light 600 is in the position shown in FIG. 10. Closing the reading publication 116, as illustrated in FIG. 8, forces the reading light 600 to the position shown. Thus, the reading light 600, when not in use, may be stored in the reading publication 116 so that the reading light 600 is ready for use the next time the reading publication 116 is opened and serves as a page marker.

Although the reading light 600 has been described in conjunction with a reading publication, the reading light 600 is ideal for use with other objects that are opened or closed such as day planners, folders, binders, and the like. For example, the bracket 604 of the reading light 600 may be attached to the cover of a day planner and stored in the day planner in the position shown in FIG. 8. When a user opens the day planner, the reading light automatically orients itself to the position shown in FIG. 9 for illuminating the day planner.

Figure 10:
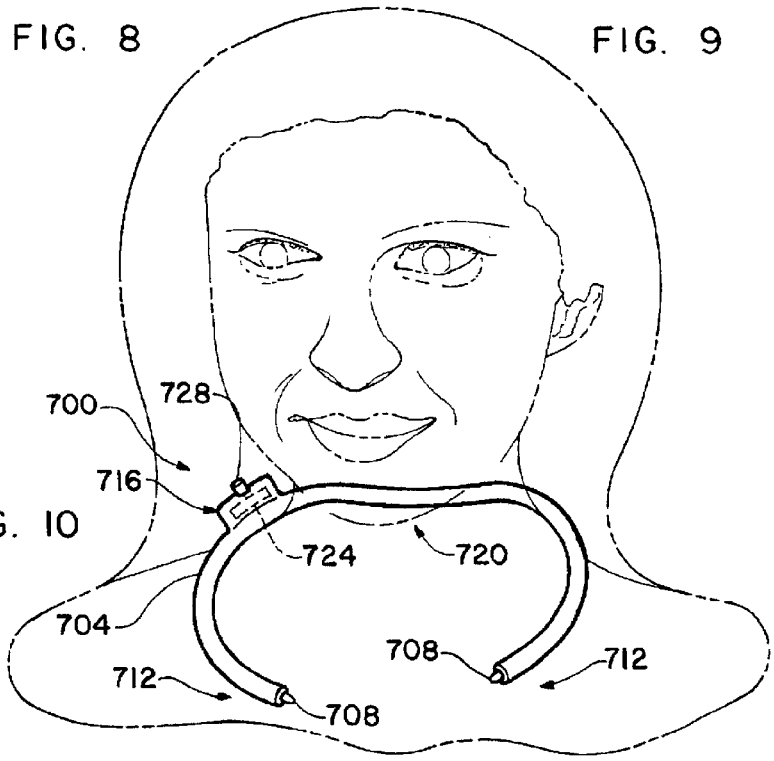
FIG. 10 is a front view of a further embodiment of a light that may be used as a reading light or general purpose light, and illustrates the light around a user's neck.

With reference to FIG. 10, a reading light 700 constructed in accordance with a still further embodiment of the invention will be described. The reading light 700 includes a bendable wire body 704 having light sources 708 located at opposite terminal portions 712 of the bendable body 704. The light sources 708 are preferably white LEDs, but may be other light sources. A power source compartment 716 may be located at or near a central portion 720 of the body 707. The power source compartment 716 houses one or more power sources 724 for powering the light sources 708. The one or more power sources 724 may include one or more batteries, e.g., watch battery, AA battery, AAA battery, AAAA battery, rechargeable battery, one or more fuel cells, or the like. The power source compartment 716 may also include a standard on/off switch 728 for turning the light sources 708 on or off. A switch may be used to either power both light sources on at once or off at once. Alternatively, a single switch or a pair of switches may be used to control power to both light sources 708 at once and individual light sources 708. The power source compartment 716 also houses suitable electronics for electrically communicating the one or more power sources 724 with the light sources 708 and controlling the light sources 708. The electronics may include a dimmer mechanism, e.g., variable resistor, for controlling the brightness of the light sources 708.

The bendable body 704 is preferably worn around the user's neck. Padding such as a compressed foam material may surround substantially all or at least a portion of the bendable body 704 for increased comfort. The central portion 720 of the reading light 700 may be made of a curved, resilient, flexible plastic material (e.g., such as that used with headphones) so that the reading light may be worn and retained on the neck or head of the user without slipping.

The reading light 700 will now be described in use. The light sources 708 of the reading light 700 are turned on using the on/off switch 728 and the bendable body 704 is wrapped around the rear half of the user's neck. The bendable body 704 allows the reading light 700 to be bent to a secure shape (e.g., horse shoe configuration) snugly yet comfortably around the user's neck for securing the bendable body 704 to the user's neck. Padding around the bendable body 704 makes the reading light more comfortable for the user to wear around his or her neck. As indicated above, the reading light 700 may also be worn on the user's head, similar to wearing a pair of headphones. In an embodiment of the reading light 700 where the reading light 700 includes the resilient, flexible material in the central portion 720, the resilient, flexible material helps to retain the reading light 700 to the user's head or neck. The opposite terminal portions 712 may be bent to a desired configuration for optimal illumination of the reading publication. The brightness of the light sources 708 may be adjusted with the dimmer mechanism.

Although the light 700 has been described as a reading light for illuminating a reading publication, the light 700 may be used to illuminate an object or objects other than reading publications. Further, the light 700 does not have to be worn around users neck or head. For example, the light 700 may be wrapped around a user's arm or other object to secure the light 700. The light 700 may also be bent to a configuration, e.g., helical configuration, where the light 700 may rest on a support surface such as table for illumination purposes. Thus, the bendable body 704 may be bent to an infinite number of positions and configurations for optimal lighting.

Although the light 100, 200, 300, 400, 500, 600, 700 has been described to illuminate a reading publication, the light may be used to illuminate a variety of other objects because the light can be conveniently secured to a variety of different support surfaces.

Figure 11:
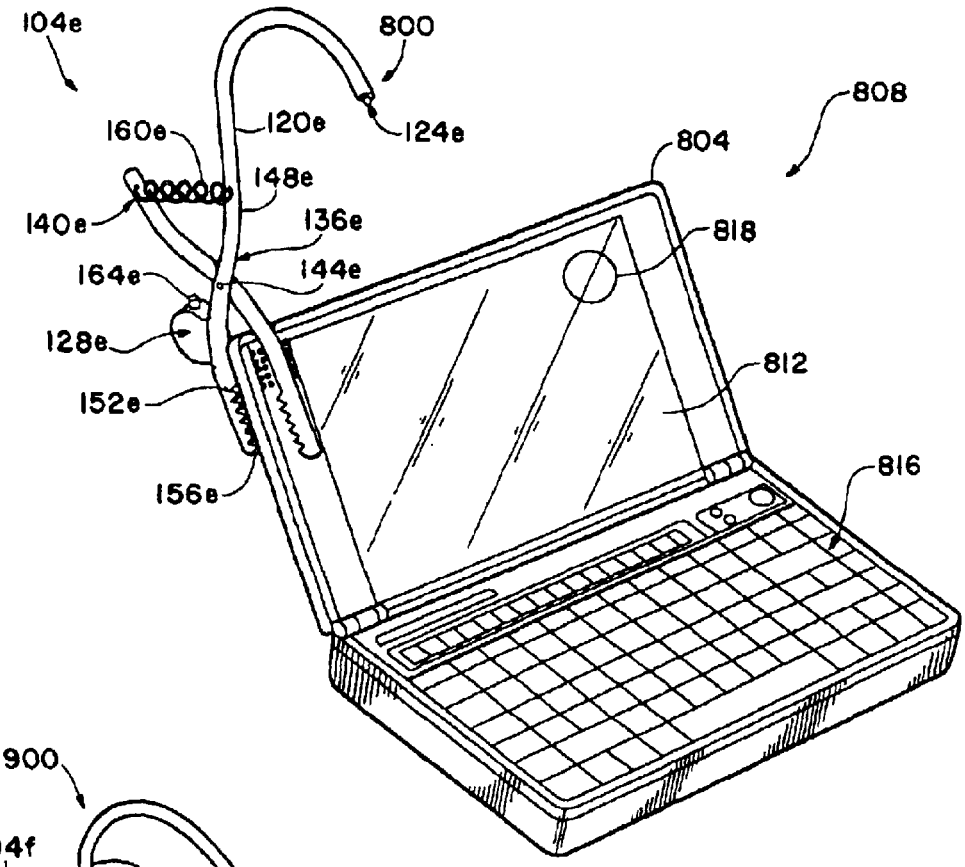
FIG. 11 is a perspective view of a light similar to the reading light illustrated in FIG. 1, but associated with a laptop computer.

For example, with reference to FIG. 11, a laptop or notebook light 800 similar in construction to the reading light 100 described with respect to FIG. 1 is shown clipped to a display frame 804 of a laptop computer 808. Elements similar to those described above with respect to FIG. 1 are identified with like reference numerals, but with an "e" suffix. The laptop light 800 may be used to illuminate objects associated with the laptop 808 such as, but not by way limitation, a screen 812, a keyboard 816, an object of a digital camera 818, or any other object(s) in the area of the laptop 808, e.g., papers, documents, etc. A method of illuminating an object of the digital camera 818 may include attaching the light 800 to a support surface such as the display frame 804, and illuminating the object of the camera 818 with an LED of the light 800. Although the light 800 has been described as being used with a digital camera, the light 800 may be used with video cameras, flash cameras, or other types of cameras. Further, the light 800 may be integrated with the camera and may draw power from the same power source as that powering the camera.

Figure 12:
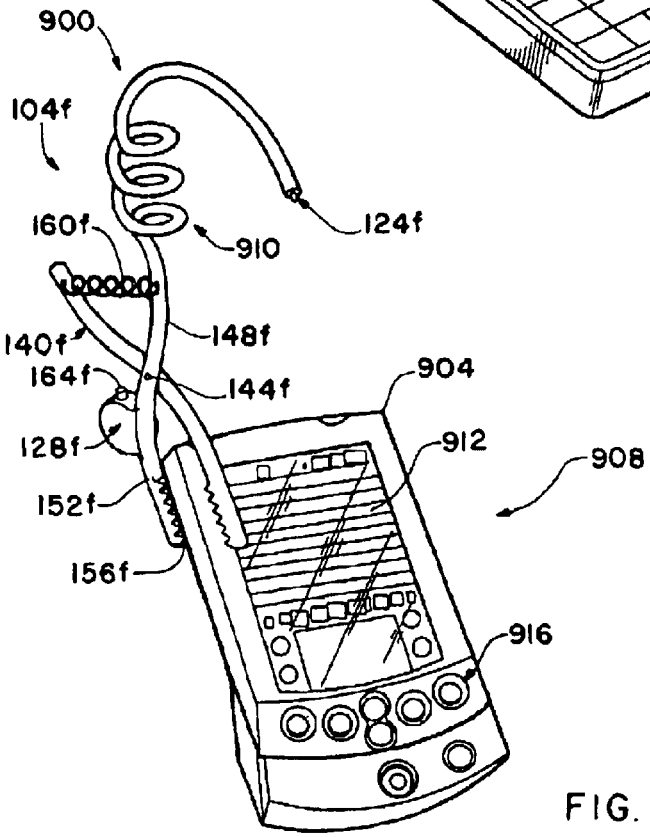
FIG. 12 is a perspective view of another embodiment of a light similar to the reading light illustrated in FIG. 1, but associated with a PDA.

With reference to FIG. 12, a Personal Digital Assistant ("PDA") light 900 similar in construction to the reading light 100 described with respect to FIG. 1 is shown clipped to a frame 904 of a PDA 908 such as a PALM PILOT®. Elements similar to those described above with respect to FIG. 1 are identified with like reference numerals, but with an "F" suffix. The PDA light 900 is similar to the reading light 100, except the PDA light 900 is shown with an helical, bendable wire body 910. Like the laptop light 800, the PDA light 900 may be used to illuminate a screen 912, a keypad 916, or anything in the area of the PDA 908

Examples of other objects that the light 100, 200, 300, 400, 500, 600, 700, 800, 900 may be used with include, but not by way of limitation, remote controls, internet phones, cell phones, non-backlit or insufficiently lit handheld video game devices, calculators, potable electronics with a display or keyboard, glucose meters, medical equipment, dental equipment, hand tools, power tools, and other hand-held devices.

It will be readily apparent to those skilled in the art that still further changes and modifications in the actual concepts described herein can readily be made without departing from the spirit and scope of the invention as defined by the following claims.

What is claimed is:

1. A method of illuminating one or more objects of a combination digital camera and light associated with a laptop computer, comprising the steps of:

providing a combination digital camera and light with the laptop computer, the combination digital camera and light integrated with one another and drawing power from the same power source, the light of the combination digital camera and light including at least one LED;

drawing power from the same power source with the integrated, combination digital camera and light;

illuminating one or more objects of the digital camera of the integrated, combination digital camera and light associated with the laptop computer with at least one LED of the light of the combination digital camera and light.

2. The method of claim 1, further including the step of attaching the light of the combination digital camera and light to a display frame of the laptop computer.

3. The method of claim 1, wherein the combination digital camera and light include a bendable body that carries the at least one LED, and the method further includes bending the body to orient the at least one LED and digital camera to a desired lighting position.

4. The method of claim 1, wherein the at least one LED and digital camera of the combination digital camera and light are powered by at least one rechargeable power source.

5. The method of claim 1, wherein the at least one LED and digital camera of the combination digital camera and light are powered by at least one watch battery.

6. The method of claim 1, further including switching the at least one LED of the combination digital camera and light on and off with a switch.

7. The method of claim 1, wherein the at least one LED of the combination digital camera and light is at least one white LED.

8. The method of claim 1, wherein the at least one LED of the combination digital camera and light is at least one wide-angle LED.

9. The method of claim 1, wherein the combination digital camera and light is integrated with the laptop computer.

* * * * *